United States Patent [19]

Corbacho, Jr.

[11] 4,123,953

[45] Nov. 7, 1978

[54] RATCHET WRENCH

[76] Inventor: Hipolito Corbacho, Jr., 401 Rock Ave. Ext., Green Brook, N.J. 08812

[21] Appl. No.: 805,100

[22] Filed: Jun. 9, 1977

[51] Int. Cl.[2] ..... B25B 13/46

[52] U.S. Cl. ..... 81/60; 76/114

[58] Field of Search ..... 81/58, 60–63.2; 145/61 A, 61 H; 76/114

[56] References Cited

U.S. PATENT DOCUMENTS

| | | | |
|---|---|---|---|
| 1,728,619 | 9/1929 | Lambert | 145/61 A |
| 3,096,659 | 7/1963 | Jenkins | 81/63.2 X |
| 3,393,587 | 7/1968 | Jolliff et al. | 81/63.2 |
| 4,039,012 | 8/1977 | Cook | 145/36 |

FOREIGN PATENT DOCUMENTS

| | | | |
|---|---|---|---|
| 2,265,500 | 3/1974 | France | 76/114 |

OTHER PUBLICATIONS

Popular Science, Oct. 1946, p. 91.

*Primary Examiner*—James L. Jones, Jr.
*Attorney, Agent, or Firm*—Lerner, David, Littenberg & Samuel

[57] ABSTRACT

An improved ratchet wrench is provided which includes an elongated handle, a circular head portion connected to the handle, a socket formed in the head portion, and a ratchet mechanism mounted within the socket. To provide increased strength characteristics, an internal core member, formed of steel, extends lengthwise within the handle and around the head portion. To provide improved insulating characteristics, an external housing, formed of rigid plastic material, completely encloses and insulates the internal steel core member.

5 Claims, 4 Drawing Figures

RATCHET WRENCH

FIELD OF THE INVENTION

The present invention relates generally to ratchet wrenches, and specifically covers an improved ratchet wrench having a unique combination of strength and insulation characteristics.

BACKGROUND OF THE INVENTION

Ratchet wrenches are well known in the prior art, and over the years, there have been many improvements to the structure of ratchet wrenches to improve their operation and durability. However, ratchet wrenches, when formed of steel, are relatively expensive to purchase. Moreover, when one considers that various size ratchet wrenches are normally purchased by a user, it will be understood that the cost of a set of steel ratchet wrenches is a relatively large investment. Accordingly, it would be highly desirable to provide a much more inexpensive ratchet wrench, but yet has sufficient strength characteristics comparable to that of steel.

In addition, as ratchet wrenches are typically formed of steel, they are not insulated and may subject the user thereof to shock when working with electrical equipment. Therefore, it would be highly desirable to provide a ratchet wrench which is totally insulated, but yet has the strength of steel.

Broadly, it is an object of the present invention to provide an improved ratchet wrench which overcomes one or more of the aforesaid objectives. Specifically, it is within the contemplation of the present invention to provide an improved ratchet wrench which has a strength comparable to that of a totally steel ratchet wrench but is much less expensive to manufacture and makes the purchase of a family of ratchet wrenches less burdensome.

It is a further object of the present invention to provide an insulated ratchet wrench which avoids the problems of electrical shock experienced by conventional ratchet wrenches but is of comparable strength.

SUMMARY OF THE INVENTION

Briefly, in accordance with the principles of the present invention, an improved ratchet wrench is provided which includes an elongated handle, a circular head portion connected to the handle and including a socket formed therein, and a ratchet mechanism mounted within the socket. To improve its strength characteristics, the ratchet wrench is provided with an internal core member formed of steel which extends lengthwise within the elongated handle and around the circular head portion. In addition, in order to insulate the ratchet wrench, an external housing, formed of rigid plastic material, completely encloses and insulates the steel internal core member.

Advantageously, in accordance with the present invention, the improved ratchet wrench is inexpensive to manufacture but yet has sufficient strength characteristics. In addition, as it is insulated, it avoids problems of electrical shock to the user.

BRIEF DESCRIPTION OF THE DRAWINGS

Further objects, features, and advantages of the present invention will become apparent upon the consideration of the following detailed description of a presently-preferred embodiment, when taken in conjunction with the accompanying drawings, wherein.

DETAILED DISCUSSION OF PREFERRED EMBODIMENT OF THE INVENTION

Figure 1:
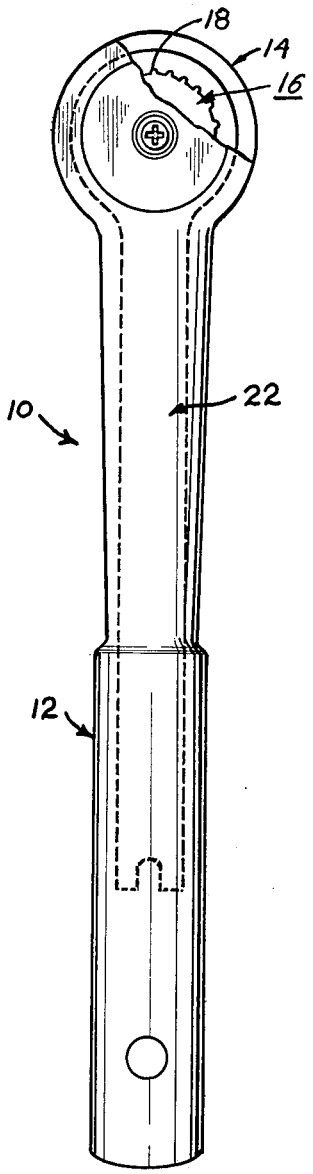
FIG. 1 is an elevational view of a ratchet wrench embodying the principles of the present invention.
Figure 3:
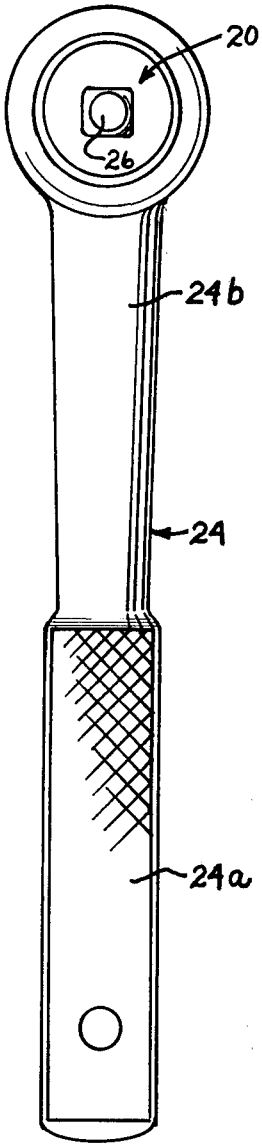
FIG. 3 is an elevational view of the ratchet wrench in accordance with the present invention.
Figure 4:
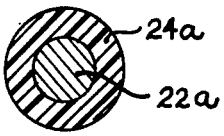
FIG. 4 is a sectional view, taken on line 4—4 of FIG. 2, illustrating the cross section of the ratchet wrench of the present invention.

Referring now to FIG. 1, there is shown the improved ratchet wrench of the present invention, generally designated by the reference numeral 10, which includes an elongated handle member 12 and a circular head portion 14 connected to the handle member 12. As is well known in the art, the head portion 14 includes a socket 16 having teeth 18 formed on the internal surface thereof for engaging the ratchet mechanism 20 shown in FIG. 3. As will be understood, ratchet mechanism 20 is of a conventional type and forms no part of the present invention.

Figure 2:
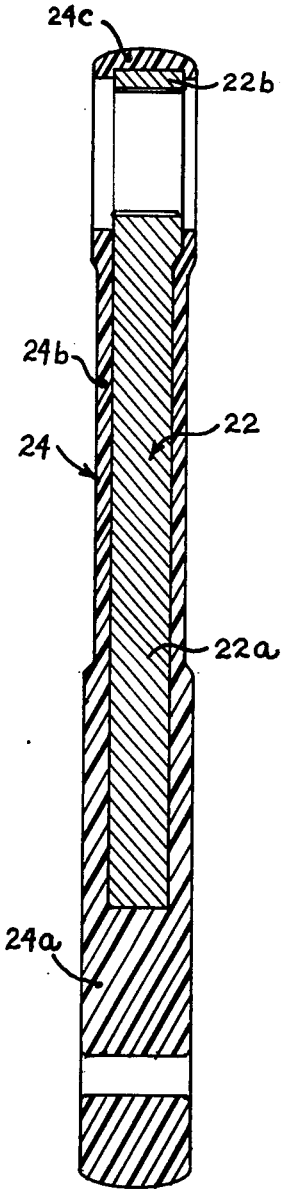
FIG. 2 is a sectional view of the ratchet wrench shown in FIG. 1.

Referring now specifically to FIGS. 1 and 2, there is shown an internal core member 22 which is formed of steel in accordance with the present invention. The steel core member 22 includes a handle section **22*a* which extends lengthwise within handle 12 to provide support. In this particular embodiment, handle section 22*a* is approximately two-thirds of the length of handle 12. In addition, the upper end of steel core member 22 includes a head section 22*b* which extends around the circular head portion 14 and is essentially circular in shape and defines socket 16**.

It will be noted that the handle section **22*a* of steel core member 22 must be of a sufficient length within elongated handle 12 to provide sufficient strength characteristics for the tool. Accordingly, in the preferred embodiment, handle section 22*a* of steel core member 22 extends at least two-thirds of the length of handle member 12** to provide the required strength characteristics.

In accordance with the present invention, there is also provided an external housing member 24 formed of rigid plastic material which encloses and insulates the steel core member 22. Housing member 24 includes handle portions **24*a*, 24*b*, and a head portion 24*c* which is essentially circular in configuration and is integrally formed with handle portions 24*a*, 24*b*. As will be noted, handle portion 24*a* is slightly larger in diameter than portion 24*b* to provide a sufficient diameter so that the tool may be easily gripped. In addition, if desired, the external surface of handle portion 24*a*** may be knurled to provide an improved grip for the tool.

As will be understood in the art, conventional ratchet mechanism 20 includes an actuating member or pin 26 so that the ratchet mechanism may be used in a clockwise or counterclockwise direction.

It is also noted that the internal steel core member 22 may be formed by any suitable forging or casting process. In addition, the external housing member 24, which is formed of plastic material, may be injection molded or formed by any other suitable process from such plastic material.

In accordance with the present invention, there has been provided an improved ratchet wrench which includes a steel internal core member which provides the tool with sufficient strength characteristics comparable to those of totally steel ratchet wrenches, which are much more expensive. In addition, the improved ratchet wrench is insulated with rigid plastic material to avoid problems with respect to electrical shock.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A ratchet wrench, comprising:

an elongated handle including a first section and a second section, a circular head portion connected to said elongated handle and including a socket, a ratchet mechanism mounted within said socket, an internal core member formed of steel, said internal steel core member being an integral member including a handle section extending longitudinally within the first section of said elongated handle and also including a head section extending around the interior of said circular head portion and having an opening defining said socket, said elongated handle and said circular head portion including an external housing formed of rigid plastic material enclosing and insulating the handle section and substantially enclosing all exterior surfaces of the head section of said internal core member, said first section of said elongated handle being formed by said internal steel handle section and being surrounded by said external plastic housing, and said second section of said handle being devoid of said steel core and being formed totally of said plastic material.

2. A ratchet wrench in accordance with claim 1, wherein said handle section extends at least two-thirds of the length of said elongated handle.

3. A ratchet wrench in accordance with claim 1, wherein the handle section of said internal core member is of uniform diameter.

4. A ratchet wrench in accordance with claim 1, wherein said socket includes teeth for engaging said ratchet mechanism.

5. A ratchet wrench in accordance with claim 1, wherein the handle section of said internal core member is circular in cross section.

* * * * *